US006554958B1

(12) United States Patent
Devic

(10) Patent No.: US 6,554,958 B1
(45) Date of Patent: Apr. 29, 2003

(54) PROCESS FOR THE DELIGNIFICATION AND BLEACHING OF CHEMICAL PAPER PULPS WITH HYDROGEN PEROXIDE AND AT LEAST ONE POLYMER

(75) Inventor: Michel Devic, Saint-Foy-les-Lyon (FR)

(73) Assignee: Atofina, Puteaux (FR)

( * ) Notice: Subject to any disclaimer, the term of this patent is extended or adjusted under 35 U.S.C. 154(b) by 0 days.

(21) Appl. No.: 08/840,305

(22) Filed: Apr. 11, 1997

(30) Foreign Application Priority Data

Apr. 12, 1996 (FR) ..... 96 04611

(51) Int. Cl.[7] ..... D21C 9/16
(52) U.S. Cl. ..... 162/72; 162/76; 162/78
(58) Field of Search ..... 162/72, 76, 78

(56) References Cited

U.S. PATENT DOCUMENTS 4,363,699 A 12/1982 DeCeuster et al.
4,787,959 A * 11/1988 Lachenal et al. ..... 162/78
4,916,178 A 4/1990 Amati et al.
5,143,580 A * 9/1992 Basta et al. ..... 162/40
5,241,026 A 8/1993 Amati et al.
5,248,389 A * 9/1993 Heimburger et al. ..... 162/78
5,540,816 A 7/1996 Andtbacka et al.
5,571,377 A 11/1996 Tibbling et al.

FOREIGN PATENT DOCUMENTS

| | | |
|---|---|---|
| GB | 1524013 | 9/1978 |
| WO | WO 95/31598 | 11/1995 |
| WO | WO 95/31599 | 11/1995 |

* cited by examiner

*Primary Examiner*—Steve Alvo

(57) ABSTRACT

A process for the delignification and bleaching of chemical paper pulps comprising one or more stage(s) of treatment with hydrogen peroxide, at a temperature greater than 100° C. and under high pressure, in the presence of a polymer and of a compound A chosen from potassium hydroxide, sodium hydroxide and alkali metal or alkaline-earth metal carbonates.

22 Claims, 3 Drawing Sheets

PROCESS FOR THE DELIGNIFICATION AND BLEACHING OF CHEMICAL PAPER PULPS WITH HYDROGEN PEROXIDE AND AT LEAST ONE POLYMER

BACKGROUND OF THE INVENTION

1.1 Technical Field

The present invention relates to a process for the delignification and bleaching of chemical paper pulps.

1.2 Description of The Related Art

Chemical paper pulps or chemical pulps are those obtained by cooking lignocellulose materials, in particular wood, in the presence of chemical agents, such as sodium hydroxide, for Kraft, sulfite or bisulfite pulps.

All types of wood may be suitable. Mention may be made, by way of example, of softwoods, such as the various species of pines and firs, or hardwoods, such as birch, poplar, beech and eucalyptus.

Chemical pulps obtained by cooking are generally subjected to a number of delignifying and/or bleaching treatment stages. The first stages, which consist of completing the delignification resulting from the cooking, are followed by the bleaching stages.

On completion of these delignifying and bleaching treatments, the pulps should generally exhibit a high whiteness level and a very low Kappa number while retaining good mechanical properties, that is to say, the pulps are without significant degradation of the cellulose. This degradation can be detected by measuring the degree of polymerization (DP) of the pulp. The DP should remain as high as possible.

Thus, patent application WO95/31598 describes a delignification and bleaching process comprising a stage of treatment with hydrogen peroxide in the presence of alkali metal silicate at a temperature (T) greater than 100° C. and at a pressure greater than 1.5 times the saturated vapor pressure of water at temperature T. As indicated in Table I of this application, the presence of silicate is necessary in order to obtain a delignified pulp having both a high whiteness level and a high DP.

Moreover, the article by Messrs. Bertel Stromberg and Richard Szopinski entitled "Pressurized Hydrogen Peroxide Bleaching for Improved TCF Bleaching" presented at the 1994 International Pulp Bleaching Conference shows that bleaching by pressurized hydrogen peroxide results in substantial degradation of the cellulose.

Contrary to these preconceived ideas, it has been discovered that chemical pulps can be treated under pressure with hydrogen peroxide and in the absence of silicate according to the present invention.

DESCRIPTION OF THE INVENTION

In fact, a new process has been discovered for the simultaneous delignification and bleaching of a chemical pulp by hydrogen peroxide to obtain a highly whitened pulp which has retained a good degree of polymerization.

This process is characterized in that, after pretreatment with a complexing or sequestering agent for transition metals, in particular, manganese, the pulp is subjected to treatment with hydrogen peroxide in one or more stages at a temperature T greater than 100° C., at a pressure greater than 1.5 times the saturated vapor pressure of water at the temperature T, in the presence of a polymer comprising units of formula (I) and/or (II):

(I)

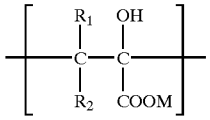

(II)

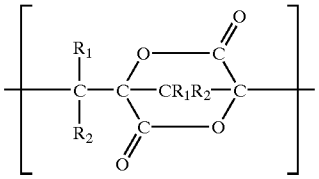

in which $R_1$ and $R_2$, which are identical or different, each represent a hydrogen atom or an alkyl group comprising from 1 to 3 carbon atoms and M represents a hydrogen atom, an ammonium group, an alkali metal, an alkaline-earth metal, or mixtures thereof and in the presence of a compound A chosen from potassium hydroxide, sodium hydroxide and alkali metal carbonates, alkaline-earth metal carbonates, or mixtures thereof.

Use is advantageously made of unsubstituted poly(α-hydroxyacrylic acid), i.e., $R_1=R_2=H$, the corresponding polylactone and/or the salts of unsubstituted poly(α-hydroxyacrylic acid). The potassium, sodium, magnesium and calcium salts are advantageously chosen from these salts, i.e., M=K, Na, Mg, Ca, or mixtures thereof.

The average molecular weight of the polymer comprising units of formula (I) and/or of formula (II) is generally between 1,000 g/mol and 800,000 g/mol and preferably between 2,000 g/mol and 100,000 g/mol.

The polymer comprising units of formula (I) and/or of formula (II) is known as a stabilizing agent for peroxide solutions (See: GB 1524013, FR 2601025). It can be prepared by using the methods described in French Patents FR 2237914, FR 2237916 and FR 2628745.

The compound A is advantageously chosen from the carbonates, such as sodium carbonate, potassium carbonate, magnesium carbonate and calcium carbonate, because the process according to the present invention offers, in this alternative form, the advantage of not producing any liquid effluent, i.e., it is Totally Effluent Free (TEF). Thus, after evaporation of the wash water (the washing is described hereinbelow) and incineration of the organic matter, the alkali metal or alkaline-earth metal carbonate is easily regenerated, without requiring a stage of causticizing with lime. Sodium carbonate is preferably used.

Unless otherwise specified, the amounts of the products and reagents according to the present invention are always expressed as percent by weight with respect to the weight of the dry matter of the pulp.

The consistency of the pulp is expressed as percent by weight of dry matter with respect to the total weight of the pulp.

In general, the amount of polymer used is between approximately 0.05% and approximately 1.5% by weight, preferably between approximately 0.1% and approximately 1%, and more preferably between approximately 0.2% and approximately 0.5%.

Depending on the starting pulp used and the amount of hydrogen peroxide involved, the compound A is added in the proportion of 1% to 15% by weight and, preferably, of 6% to 10% for the carbonates.

The amount of hydrogen peroxide used can vary from 0.5% to approximately 10% by weight. Use is preferably made of an amount of hydrogen peroxide of between approximately 1% and approximately 4% and, more preferably, between approximately 1.5% and approximately 2.5%.

During the stage of treatment with hydrogen peroxide, use may additionally be made of a sequestering agent, such as DTPA (sodium diethylenetriaminepentaacetate) or EDTA (sodium ethylenediaminetetraacetate), preferably in an amount of less than 0.2% by weight.

According to the present invention, the pulp, before treatment with hydrogen peroxide, can be subjected to one or more stage(s) of delignification by ozone and/or chlorine dioxide and/or organic peracids and/or inorganic peracids and/or oxygen, as known in the paper industry. Oxygen is preferably used.

On completion of the delignifying treatment, the pulp can be washed once or several times with hot or cold water.

Any pulp having a Kappa number (per SCAN standard Cl-59) not exceeding 17 before treatment with hydrogen peroxide is particularly suitable. MCC (modified continuous cooking) pulps, EMCC (extended modified continuous cooking) pulps and Super Batch pulps, the Kappa number of which, after cooking, can reach values as low as 15–18 for softwoods and 13–15 for hardwoods, are advantageously used.

The complexing or sequestering agent for transition metals used in the pretreatment can be chosen from DTPA, EDTA, phosphoric acids or salts of phosphoric acids. It is also possible to combine a number of agents in order to increase the efficiency of the pretreatment with respect to a greater number of metals.

The amount of complexing or sequestering agent is generally between approximately 0.05% and approximately 1% by weight. Use is preferably made of an amount of between approximately 0.1% and approximately 0.5%.

The temperature of the pretreatment is generally from 20° C. to 100° C. and preferably between approximately 60° C. and approximately 90° C.

The duration of the pretreatment with the complexing agent is generally from 1 to 30 minutes and preferably from 5 to 15 minutes.

The consistency of the pulp during the pretreatment can vary within limits ranging from 1% to 25% by weight. A consistency of between 5% and 15% is preferred.

Although the pretreatment with the complexing agent can be carried out in a medium at acidic pH, it is preferable to carry out the pretreatment at basic pH. The pH is advantageously greater than 7 and less than or equal to 12.5. A pH of between 8 and 10 is particularly preferred.

The alkaline pH during the pretreatment can be obtained either via the residual alkalinity of the pulp on completion of the treatment with oxygen or via the alkalinity of the complexing or sequestering agent or, alternatively, via the addition of a base, such as NaOH.

For the majority of pulps, the residual alkalinity of the pulp, combined with that of the DTPA, makes it possible to obtain a pH of approximately 9 without the addition of sodium hydroxide.

Preferably, the manganese content of the pulp before treatment with hydrogen peroxide does not exceed 5 ppm by weight with respect to the weight of the dry matter of this same pulp.

On completion of the complexing pretreatment, the pulp is washed with water. Washing can be carried out according to the known techniques of the paper industry with hot or cold water.

In a first embodiment, hydrogen peroxide, compound A, the polymer comprising units of formula (I) and/or (II) and, optionally, water, used in order to obtain the desired consistency, are added to the pulp resulting from the complexing pretreatment. The reagents are preferably added to the pulp at ambient temperature or at a temperature of less than approximately 60° C. The mixture is then subjected to a pressure greater than 1.5 times the saturated vapor pressure of water at the treatment temperature T. Then, the mixture is brought to the temperature T.

According to a second embodiment, it is possible, in a first step, to increase the pressure and then to mix the reagents with the pulp and simultaneously increase the temperature.

The operation is preferably carried out according to the first embodiment.

Devices generally employed in the paper industry for cooking pulps, and which also make it possible to maintain the pulp impregnated with the aqueous hydrogen peroxide solution, compound A and the polymer at a high pressure and at a high temperature for the chosen duration, can be suitable for implementing the stage of treatment with hydrogen peroxide according to the invention.

After this treatment, the pulp is decompressed, optionally cooled, and then washed with water so as to remove all soluble organic and inorganic matter. The wash water can then be concentrated by evaporation and incinerated in a boiler according to the usual techniques of the paper industry. The ash obtained is mostly composed of carbonate which can be recycled after purification.

The effluent arising from this treatment stage, which contains only organic matter and metal carbonates and which is free from chloride and from silicate, can also be treated with the effluent arising from the Kraft pulp unit (black liquor).

The consistency of the pulp during the treatment with hydrogen peroxide is generally between approximately 4% and 35% by weight. The process can be carried out efficiently at low consistency, from approximately 4% to approximately 10%, and the reaction mixture can be easily transferred by pumping.

A pulp consistency of between approximately 15% and approximately 25% by weight makes it possible to obtain high levels of whiteness and of delignification while saving on heating energy. A consistency of between approximately 8% and approximately 20% is advantageously chosen because it allows the yield of the process to be optimized.

Preferably, before the temperature of the medium exceeds 100° C., the pressure to which the pulp is subjected generally reaches a value greater than 1.5 times the saturated vapor pressure of water at the temperature T of the treatment with hydrogen peroxide. The pressure is preferably greater than 2 times the saturated vapor pressure of water at the treatment temperature T.

Use is advantageously made of a pressure of between 5 and 200 bars absolute. For practical operational reasons, the pressure is preferably between 5 and 50 bars absolute. A pressure of between 5 and 20 bars absolute is more preferred for economic reasons.

The pulp can be pressurized by any appropriate means which makes it possible to obtain a pressure greater than 1.5 times the saturated vapor pressure of water at the treatment temperature T. Thus, this pressure can be established by using a compressed gas, such as air or nitrogen. It can also be obtained by pumping the pulp with a high pressure positive displacement or centrifugal pump in a closed chamber.

The reaction temperature T is most often between 110° C. and 180° C. and advantageously from 120° C. to 150° C.

The treatment with hydrogen peroxide generally has a duration of 1 minute to 3 hours. The duration varies inversely with increased temperature, e.g., as T increases the duration of the hydrogen peroxide treatment decreases. The duration is preferably from 15 minutes to 1 hour. These relatively short durations make it possible to increase the hourly yield in the manufacture of the delignified and bleached pulp.

On completion of the treatment with hydrogen peroxide, the pulp can be subjected to a second treatment stage under the same conditions as above or under the usual conditions (temperature less than 90° C., atmospheric pressure, alkaline medium in the presence either of magnesium sulfate or of sodium silicate) or it can be subjected to treatment with chlorine dioxide under the known conditions of the paper industry.

The definitions of the following terms, used above and subsequently, correspond to their definitions found in the following standards:

Whiteness: ISO standard 2470

Kappa number: SCAN standard C1-59

Degree of polymerization (DP): SCAN standard SC 15-12.

DESCRIPTION OF THE PREFERRED EMBODIMENTS

Experimental Part

Figure 1:
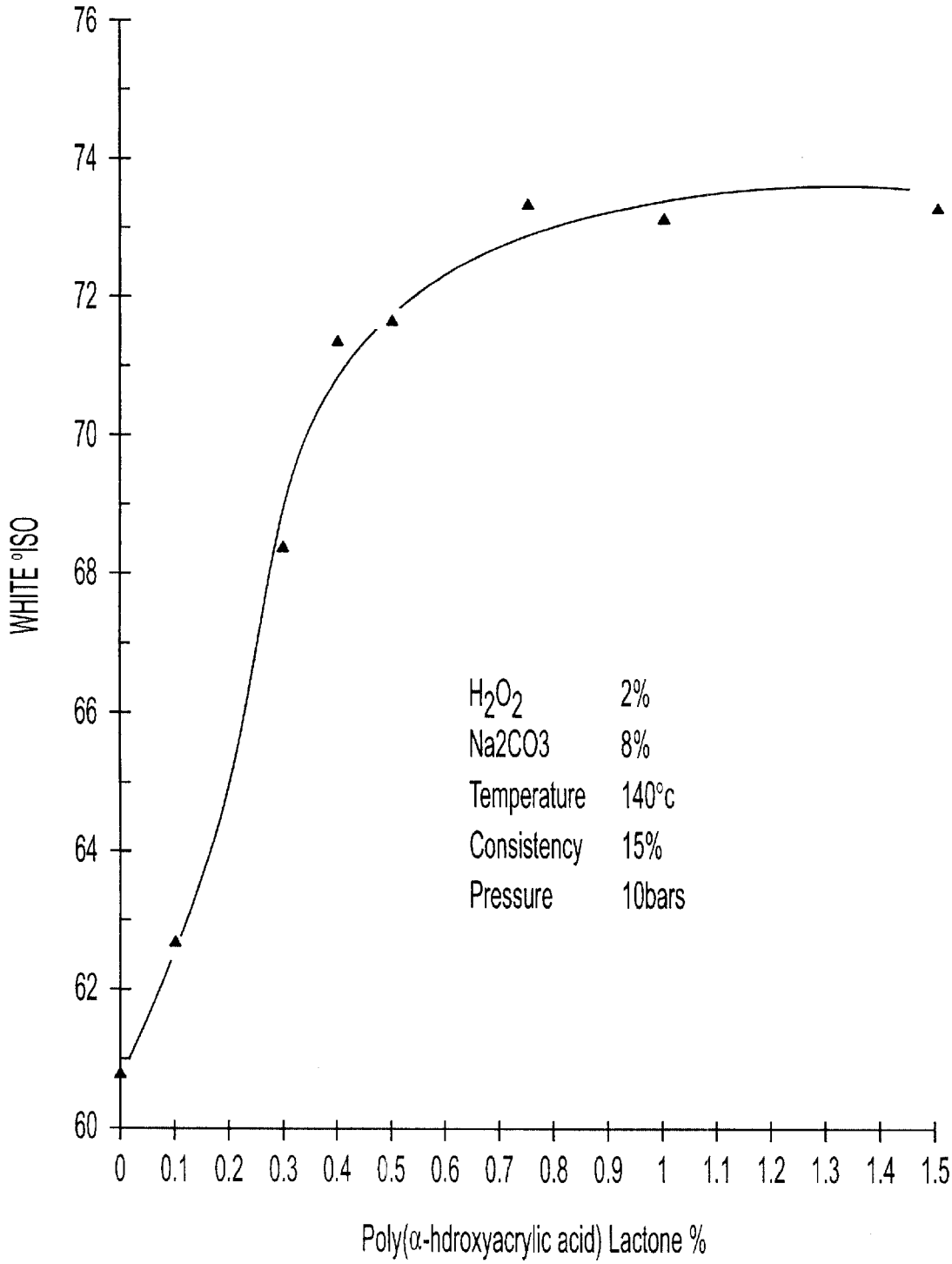
FIGS. 1–3 show the beneficial effect of sodium carbonate and of polylactone on the whiteness and the degree of polymerization of the HK1 pulp.
Figure 2:
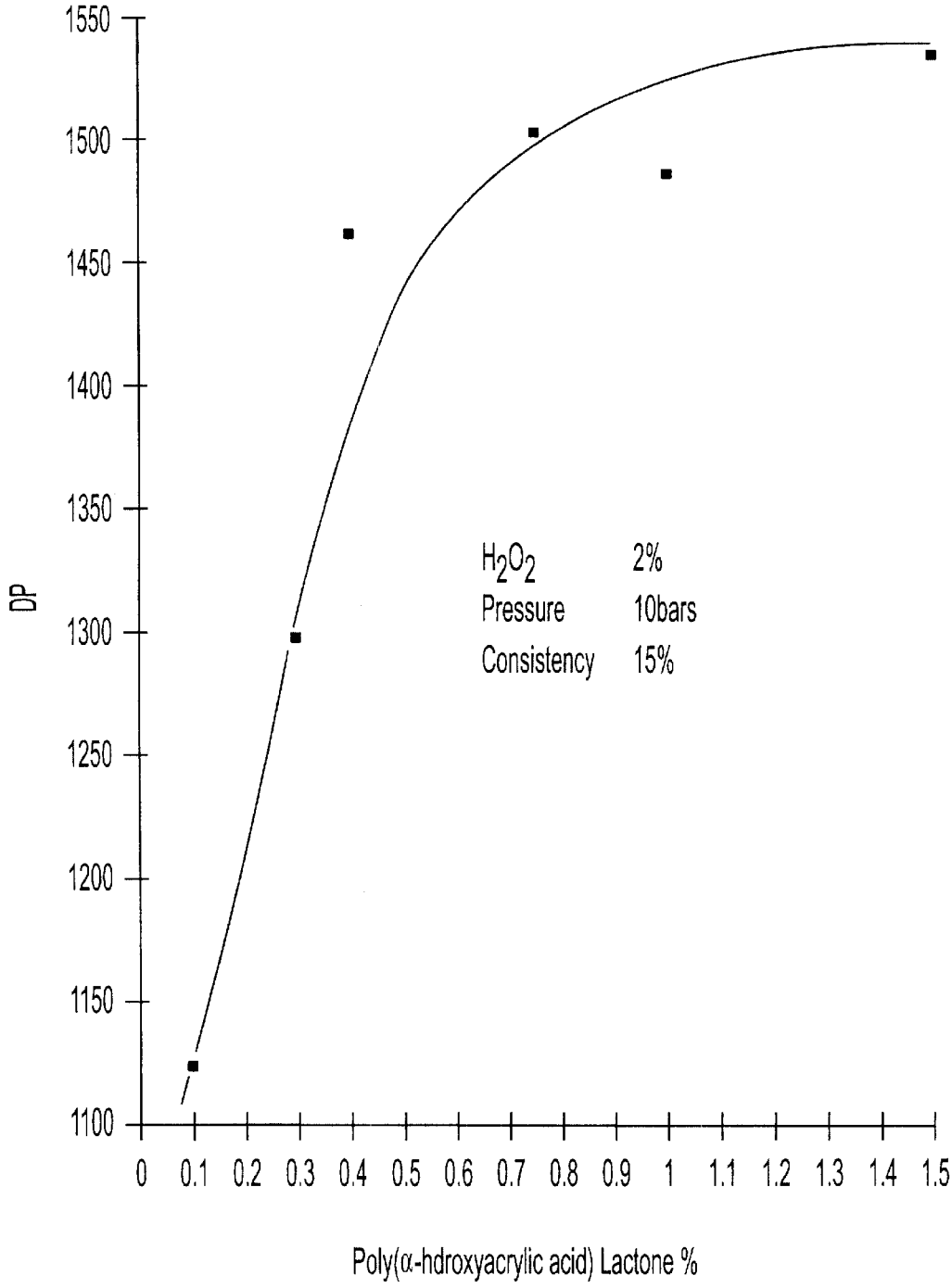
Figure 3:
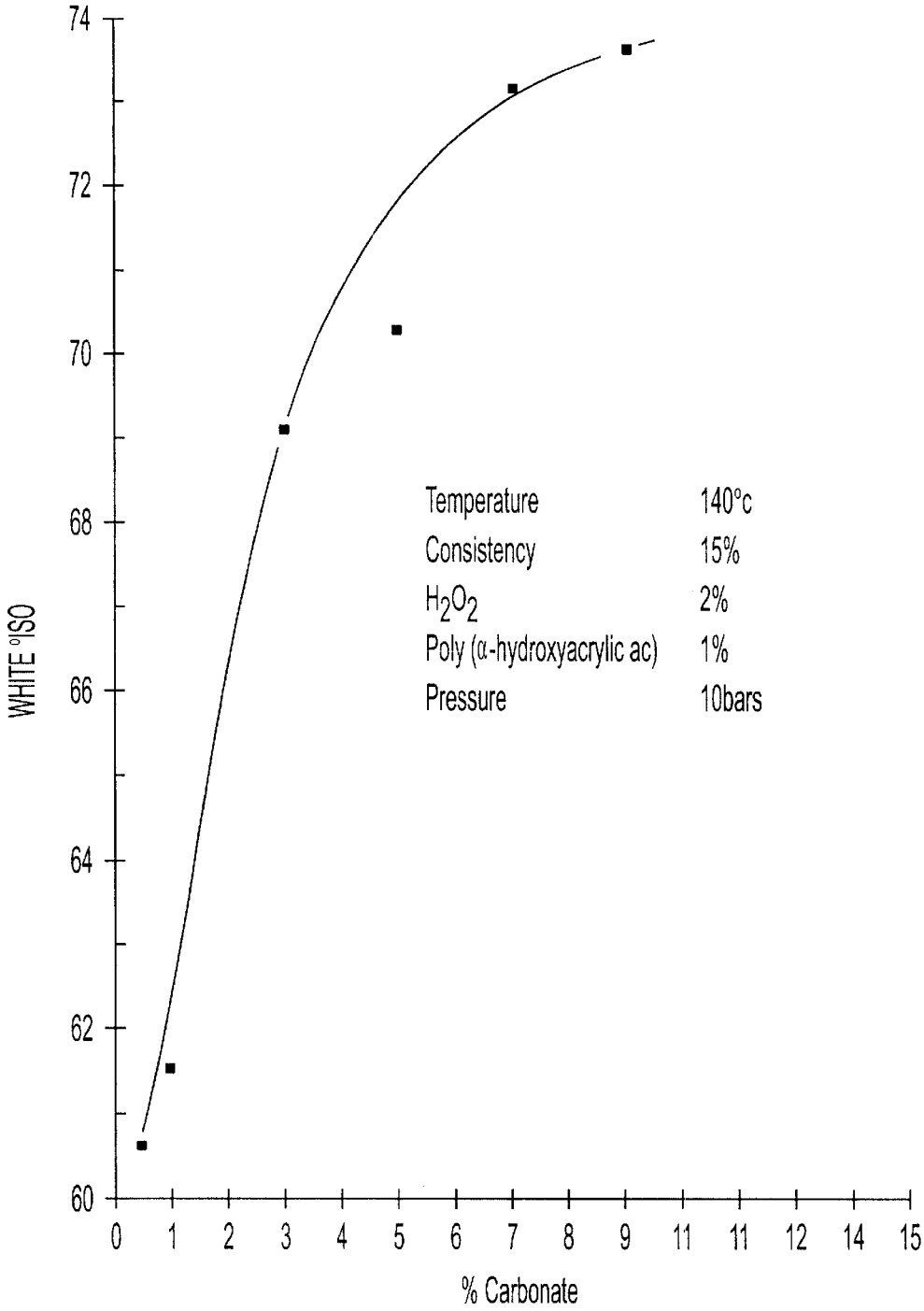

4.1 General Procedure a) Pretreatment with the Completing or Sequestering Agent The pulp, after cooking and, optionally, after delignification with oxygen, is suspended at a consistency of 10% with 0.5% of a commercial 40% by weight DTPA solution and heated for 15 minutes at 90° C. The final pH is from 8 to 10, depending on the pulp chosen.

The pulp is then filtered and washed with demineralized water.

b) Treatment with Pressurized Hydrogen Peroxide

The aqueous hydrogen peroxide solution, compound A, poly(α-hydroxyacrylic acid) or the corresponding polylactone and demineralized water necessary to obtain the chosen consistency are added to the pulp collected in step (a). The reaction mixture thus obtained is then placed in a stainless steel autoclave. The completely filled autoclave is pressurized with compressed air and then heated to the chosen temperature T for the chosen duration. The valve for degassing the autoclave is intermittently opened in order to maintain the pressure at the chosen reaction value.

After reaction, the autoclave is cooled, then decompressed, and the pulp is collected on a filter and washed with demineralized water. The whiteness, the Kappa number and the DP are then measured according to the paper industry standards cited previously.

The wash water can be concentrated by evaporation and then incinerated. The ash, composed mainly of sodium carbonate, can be recycled.

In all the examples, the amounts of reagents are expressed as percent by weight with respect to the weight of the dry matter of the pulp and the pressures are, unless otherwise indicated, expressed as relative pressure.

Use is made, in Examples 1 to 13, of a hardwood Kraft pulp (HK1) of industrial origin which is obtained by cooking and which has the following characteristics:

| | |
|---|---|
| Whiteness | =34.8° ISO |
| Kappa number | =15.2 |
| DP | =2100 |

EXAMPLE 1

The pulp (HK1) is subjected to the pretreatment (a) with the sequestering agent and then treated with hydrogen peroxide under the following conditions:

| | | |
|---|---|---|
| Consistency | = | 15% |
| Temperature | = | 140° C. |
| Duration | = | 20 minutes |
| Pressure | = | 10 bars |
| $H_2O_2$ | = | 2% |
| $Na_2CO_3$ | = | 10% |

Polylactone of poly(α-hydroxyacrylic acid) (PPHA)=1%.

The pH of the pulp after the pretreatment is 9.5. On completion of the treatment, 99% of the hydrogen peroxide has been consumed and the final pH is 9.4.

The degree of whiteness of the pulp is 73.7° ISO, the Kappa number (KN) is 7.4 and the degree of polymerization (DP) is equal to 1,500.

EXAMPLE 2

(Comparative)

The operation is carried out in the same way as in Example 1, except in the absence of poly(α-hydroxyacrylic acid) and/or the corresponding polylactone. The degree of whiteness is then equal to 60.8° ISO, the KN is 8 and the DP is 1,100.

EXAMPLES 3 to 8

The operation is carried out in the same way in Example 1, except that the amount of polylactone is varied.

EXAMPLES 9 to 13

The operation is carried out in the same way as in Example 1, except that the amount of sodium carbonate is varied.

The characteristics of the pulp obtained on completion of the tests of Examples 1 to 13 are summarized in Table I.

TABLE I

| Example | $Na_2CO_3$ | PPHA Polymer % | White °ISO | KN | DP |
|---|---|---|---|---|---|
| 1 | 10 | 1 | 73.7 | 7.4 | 1500 |
| 2 | 10 | 0 | 60.8 | 8 | 1100 |
| 3 | 10 | 0.1 | 62.7 | 7.9 | 1125 |
| 4 | 10 | 0.3 | 68.4 | 7.9 | 1300 |
| 5 | 10 | 0.4 | 71.4 | 7.8 | 1460 |
| 6 | 10 | 0.5 | 71.7 | 7.6 | nd |
| 7 | 10 | 0.75 | 73.4 | 7.6 | nd |
| 8 | 10 | 1.5 | 73.6 | 7.6 | nd |
| 9 | 1.5 | 1 | 60.6 | nd | nd |
| 10 | 2 | 1 | 61.5 | nd | nd |
| 11 | 4 | 1 | 69.1 | nd | nd |

TABLE I-continued

| Example | $Na_2CO_3$ | PPHA Polymer % | White °ISO | KN | DP |
|---|---|---|---|---|---|
| 12 | 6 | 1 | 70.3 | nd | nd |
| 13 | 8 | 1 | 73.2 | nd | nd |

nd = not determined

EXAMPLES 14 to 19

A hardwood Kraft pulp (HK2) having the following characteristics:

| | | | |
|---|---|---|---|
| Whiteness | = | 50.1° | ISO |
| Kappa number | = | 9.7 | |
| DP | = | 1400 | |

after cooking and delignification with oxygen, was used in Examples 14 to 19.

After pretreatment with the complexing agent as described in step (a), the pulp is bleached under the conditions recorded in Table II. The characteristics of the pulp on completion of the treatment with hydrogen peroxide are also reported in Table II.

Use is made, in Example 18, of 8% of a commercial sodium silicate solution (with a density of 1.33) in place of the carbonate and the poly(α-hydroxyacrylic acid).

Example 19 is not in accordance with the invention, because a pressure equal to the saturated vapor pressure of water at the treatment temperature was applied.

EXAMPLES 20 to 26

A softwood Kraft pulp (SK1) having the following characteristics:

| | | | |
|---|---|---|---|
| Whiteness | = | 34.5° | ISO |
| Kappa number | = | 12.4 | |
| DP | = | 1100 | |

after cooking and delignification with oxygen, is subjected to the sequestering treatment of step (a) in basic medium (final pH=9.3) and then treated with hydrogen peroxide under the conditions mentioned in Table III.

Example 21, not in accordance with the invention, was carried out in the absence of polymer. Examples 25 and 26 are comparative tests with the use of sodium hydroxide and of silicate or of sodium hydroxide and of magnesium sulfate in place of sodium carbonate and the polylactone.

EXAMPLES 27 to 41

A hardwood Kraft pulp (HK3) of industrial origin, having the following characteristics:

| | | | |
|---|---|---|---|
| Whiteness | = | 31.9° | ISO |
| Kappa number | = | 15.2 | |
| DP | = | 1600 | |

after cooking and delignification with oxygen, is subjected to the pretreatment of step (a) with the complexing agent in basic medium and is then treated with hydrogen peroxide under the operating conditions reported in Table IV.

Examples 35 and 40 are comparative examples not in accordance with the invention.

TABLE II

| Example | Consistency % | Temperature ° C. | Duration min | Pressure bar | $H_2O_2$ % | $Na_2CO_3$ % | PPHA Polymer % | White °ISO | KN | DP |
|---|---|---|---|---|---|---|---|---|---|---|
| 14 | 15 | 150 | 20 | 10 | 2 | 6 | 0.5 | 81.6 | 6.1 | 1000 |
| 15 | 15 | 130 | 60 | 10 | 2 | 6 | 0.5 | 80.3 | 6.2 | 1170 |
| 16 | 15 | 140 | 20 | 30 | 2 | 6 | 0.5 | 81.2 | 6.1 | 1120 |
| 17 | 15 | 130 | 40 | 10 | 3 | 8 | 0.5 | 83.2 | 6.1 | 900 |
| 18 | 15 | 150 | 20 | 10 | 2 | 0 | 8% silicate | 77.6 | 6.6 | 1300 |
| 19 | 15 | 150 | 20 | 3.8 | 2 | 6 | 0.5 | 74.6 | 6.7 | 1100 |

TABLE III

| Example | Consistency % | Temperature ° C. | Duration min | Pressure bar | $H_2O_2$ % | $Na_2CO_3$ % | PPHA Polymer % | White °ISO | KN | DP |
|---|---|---|---|---|---|---|---|---|---|---|
| 20 | 15 | 140 | 20 | 10 | 2 | 8 | 0.5 | 70.3 | 5.1 | 960 |
| 21 | 15 | 140 | 20 | 10 | 2 | 8 | 0 | 59.1 | 5.6 | 910 |
| 22 | 15 | 140 | 20 | 10 | 2 | 8 | 0.1 | 66 | 5 | nd |
| 23 | 15 | 140 | 20 | 10 | 2 | 8 | 0.3 | 70 | 4.8 | 960 |
| 24 | 15 | 140 | 20 | 10 | 2 | 8 | 0.75 | 70 | 4.9 | 960 |
| 25 | 15 | 150 | 30 | 10 | 2 | 0.5% sodium hydroxide | 4% silicate | 67 | 3.4 | 1040 |
| 26 | 15 | 140 | 20 | 10 | 2 | 3.5% sodium hydroxide | 0.1% sulphate | 57.5 | 5.3 | 910 |

nd = not determined

TABLE IV

| Example | Consistency % | Temperature ° C. | Duration min | Pressure bar | $H_2O_2$ % | $Na_2CO_3$ % | PPHA Polymer % | White °ISO | KN | DP |
|---|---|---|---|---|---|---|---|---|---|---|
| 27 | 15 | 140 | 20 | 10 | 1 | 6 | 1 | 61.5 | 8.3 | nd |
| 28 | 15 | 140 | 20 | 10 | 2 | 6 | 1 | 72.8 | 6.8 | 1070 |
| 29 | 15 | 140 | 20 | 10 | 3 | 6 | 1 | 77.9 | 6.3 | nd |
| 30 | 15 | 140 | 20 | 10 | 4 | 6 | 1 | 81.3 | 5.7 | nd |
| 31 | 10 | 140 | 20 | 10 | 2 | 6 | 1 | 70 | 7.4 | nd |
| 32 | 20 | 140 | 20 | 10 | 2 | 6 | 1 | 72.5 | 6.9 | nd |
| 33 | 15 | 130 | 20 | 10 | 2 | 6 | 1 | 70.7 | 6.9 | nd |
| 34 | 15 | 150 | 20 | 10 | 2 | 6 | 1 | 72.4 | 6.7 | nd |
| 35 | 15 | 140 | 20 | 2.6 | 2 | 6 | 1 | 67 | 8 | nd |
| 36 | 15 | 140 | 20 | 20 | 2 | 6 | 1 | 73.3 | 6.7 | nd |
| 37 | 15 | 140 | 30 | 10 | 2 | 8 | 1 | 73.1 | 6.9 | 1120 |
| 38 | 15 | 140 | 30 | 10 | 2 | 6 | 1 | 73.7 | 6.8 | 1110 |
| 39 | 15 | 140 | 30 | 10 | 2 | 4 | 1 | 71.6 | 7.5 | nd |
| 40 | 15 | 140 | 30 | 10 | 2 | 8 | 0 | 61 | 7.2 | nd |
| 41 | 15 | 140 | 30 | 10 | 2 | 2% sodium hydroxide | 1 | 71.3 | 7 | 1300 |

nd = not determined

What is claimed is:

1. A process for the delignification and bleaching of a chemical pulp consisting of a plurality of stages, comprising: (1) contacting the pulp with a complexing or sequestering agent for transition metals in a pretreatment stage; and (2) treating the pulp with hydrogen peroxide in at least one stage at a temperature T greater than 100° C., at a pressure greater than 1.5 times the saturated vapor pressure of water at the temperature T, in the presence of (a) at least one polymer comprising units selected from the group consisting of formula (I), formula (II) and mixtures of formula (I) and formula(II):

(I)

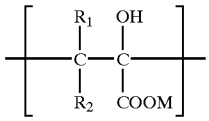

(II)

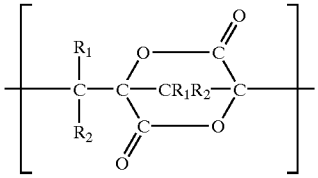

in which $R_1$ and $R_2$, which are identical or different, each independently represent a hydrogen atom or an alkyl group comprising from 1 to 3 carbon atoms and in which M is selected from the group consisting of a hydrogen atom, an ammonium group, an alkali metal, an alkaline-earth metal, and mixtures thereof, and in the presence of (b) a compound A chosen from the group consisting of potassium hydroxide, sodium hydroxide, an alkali metal carbonate, alkaline-earth metal carbonate and mixtures thereof.

2. The process according to claim 1, characterized in that, before treatment with hydrogen peroxide, the pulp is subjected to at least one delignification stage comprising contacting the pulp with at least one delignifying agent.

3. The process according to claim 2, characterized in that the delignifying agent is chosen from the group consisting of oxygen, ozone, an organic peracid and an inorganic peracid.

4. The process according to claim 1, characterized in that the complexing agent is DTPA.

5. The process according to claim 4, characterized in that the pH of the mixture, during the pretreatment stage, is between 8 and 10.

6. The process according to claim 1, characterized in that the compound A is sodium carbonate.

7. The process according to claim 6, characterized in that the amount of sodium carbonate used is between 1% and 15% with respect to the dry matter of the pulp.

8. The process according to claim 1, characterized in that the polymer is chosen from the group consisting of poly(α-hydroxyacrylic acid), a corresponding salt of poly(α-hydroxyacrylic acid) and the polylactone of poly(α-hydroxyacrylic acid).

9. The process according to claim 8, characterized in that the average molecular weight of the polymer is between 2,000 g/mol and 100,000 g/mol.

10. The process according to claim 8, characterized in that the amount of the polymer used is between 0.1% and 1% with respect to the mass of the pulp in the dry state.

11. The process according to claim 1, characterized in that the pressure of the mixture has reached a value greater than 1.5 times the saturated vapor pressure of water at the temperature T before the temperature of the mixture exceeds 100° C.

12. A process for the delignification and bleaching of a chemical pulp consisting of a plurality of stages, comprising: (1) bringing the pulp into contact with a complexing or sequestering agent for transition metals in a pretreatment stage; and (2) subjecting the pulp to treatment with hydrogen peroxide in at least one stage at a temperature T greater than 100° C., at a pressure greater than 1.5 times the saturated vapor pressure of water at the temperature T, in the presence of (a) at least one polymer comprising units selected from the group consisting of formula (I), formula (II) and mixtures of formula (I) and formula (II):

(I)

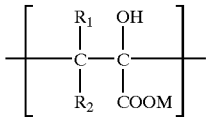

-continued (II)

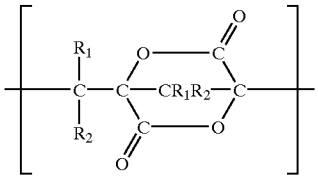

in which $R_1$ and $R_2$, which are identical or different, each independently represent a hydrogen atom or an alkyl group comprising from 1 to 3 carbon atoms and in which M is selected from the group consisting of a hydrogen atom, an ammonium group, an alkali metal, an alkaline-earth metal, and mixtures thereof, and in the presence of (b) a compound A chosen from the group consisting of potassium hydroxide, sodium hydroxide, an alkali metal carbonate, an alkaline-earth metal-carbonate and mixtures thereof; (3) washing the pulp with water on completion of the final treatment with hydrogen peroxide; and (4) incinerating the wash water.

13. The process according to claim 12, characterized in that, before treatment with hydrogen peroxide, the pulp is subjected to at least one delignification stage comprising contacting the pulp with at least one delignifying agent.

14. The process according to claim 13, characterized in that the delignifying agent is chosen from the group consisting of oxygen, ozone, an organic peracid and an inorganic peracid.

15. The process according to claim 12, characterized in that the complexing agent is DTPA.

16. The process according to claim 5, characterized in that the pH of the mixture, during the pretreatment stage, is between 8 and 10.

17. The process according to claim 12, characterized in that the compound A is sodium carbonate.

18. The process according to claim 17, characterized in that the amount of sodium carbonate used is between 1% and 15% with respect to the dry matter of the pulp.

19. The process according to claim 12, characterized in that the polymer is chosen from the group consisting of poly(α-hydroxyacrylic acid), a corresponding salt of poly (α-hydroxyacrylic acid) and the polylactone of poly(α-hydroxyacrylic acid).

20. The process according to claim 19, characterized in that the average molecular weight of the polymer is between 2,000 g/mol and 100,000 g/mol.

21. The process according to claim 19, characterized in that the amount of the polymer used is between 0.1% and 1% with respect to the mass of the pulp in the dry state.

22. The process according to claim 12, characterized in that the pressure of the mixture has reached a value greater than 1.5 times the saturated vapor pressure of water at the temperature T before its temperature exceeds 100° C.

* * * * *